United States Patent [19]

Erba

[11] 4,210,091

[45] Jul. 1, 1980

[54] AUTOMATIC MACHINE FOR CONTINUOUSLY PRODUCING TINNED STRAP CAPS FITTED WITH OPENING DEVICES AND DEVICES THEREFOR

[76] Inventor: Mario Erba, Via Monfalcone 14, Monza (Milano), Italy

[21] Appl. No.: 896,019

[22] Filed: Apr. 12, 1978

[30] Foreign Application Priority Data

| | | | |
|---|---|---|---|
| Sep. 28, 1977 | [IT] | Italy | 28039 A/77 |
| Jul. 17, 1978 | [IT] | Italy | 20486/78[U] |
| Jan. 17, 1978 | [IT] | Italy | 19306 A/78 |

[51] Int. Cl.[2] ..... B21D 43/00

[52] U.S. Cl. ..... 113/113 D; 29/793; 113/1 F; 113/121 C

[58] Field of Search ..... 29/771, 793, 809, DIG. 30; 113/1 F, 121 C, 116 W, 113 D

[56] References Cited

U.S. PATENT DOCUMENTS

| | | | |
|---|---|---|---|
| 1,606,432 | 11/1926 | Herkenhine | 113/113 D X |
| 2,148,248 | 2/1939 | Swangren | 113/1 F |
| 3,948,415 | 4/1976 | Debenham | 113/121 C |
| 4,026,226 | 5/1977 | Hahn | 113/1 F |

*Primary Examiner*—Leon Gilden

*Attorney, Agent, or Firm*—Haseltine, Lake & Waters

[57] ABSTRACT

An automatic machine for continuously producing tinned strap caps fitted with a tear opening device, characterized by comprising a disc rotating about its axis at a constant speed, including a central portion and an outer circular crown, the latter being provided with a first plurality of supporting elements or lower slides, only radially movable to receive the caps supplied by a shaped double blade magazine, and a second plurality of supporting elements or upper slides, also only radially movable, to receive the tear opening devices supplied by a second double blade magazine, said crown being also provided with a plurality of passage holes, through which each of the tear elements are positioned on the corresponding cap, the central portion carrying a plurality of joining members only vertically movable, further characterized in that the radial movement for the lower slides adjacent the cap dispenser or magazine is controlled by a flat metal cam-shaped guide, during the movement of the rotable disc, drive rollers connected to said lower slides sliding therein, that the radial movement for the upper slides adjacent the tear element dispenser is controlled by a central cam integral with the axis of rotation for the rotable disc, that the vertical movement for the joining members is controlled by a circular metal guide of varying height, in which feeler rollers slide following the profile thereof and transferring such a movement to the joining members by connection stems, further characterized in that a further circular metal guide of varying height controls the lifting and lowering of a plurality of abutting pistons raising with the underside of the caps and by providing an extractor or puller for the finished pieces located adjacent the dispensers or magazines, but upstream thereof.

6 Claims, 18 Drawing Figures

AUTOMATIC MACHINE FOR CONTINUOUSLY PRODUCING TINNED STRAP CAPS FITTED WITH OPENING DEVICES AND DEVICES THEREFOR

This invention relates to an automatic machine for continuously producing tinned strap caps fitted with opening devices, and is also concerned with said devices which may be of different type depending on the kind of product to which the container is intended for, the type and size of opening to be provided and characteristics of simplicity, practicalness and economicity being required.

The preservation of foodstuffs (such as foods, drinks, vegetable and animal oils) and industrial products (such as lubricants, solutions for industrial use, etc.) require an increasing use of capped containers with rip off opening and of the type generally referred to as "easy open" having the most varied shapes and size.

The prevailing material being used for the cap is that referred to as tinned strap having characteristics of high reliability over other materials that have been tested or used.

This material comprises a soft iron sheet protected on the two faces by a layer of tin (preferably electrolytic tin) with that face internally of the box usually painted of gold or white colour.

The joining systems between the cap and opening device are of different type, prevailingly by soft soldering, followed by rivet drawing (wherein a projection provided by drawing on the cap is inserted in a hole in the device and then riveted so that the cap and device are made integral) and finally by cold pressure glueing.

Said different joining systems and the necessity of providing caps and opening devices of the most varied shapes and size (as readily appreciated from the commercially available products) give rise to such problems in connection with the machine implementation to operate such a join that hitherto have not been satisfactorily solved.

First, no machine is known which is capable of effecting alone and a few modifications before the start of the producing cycle said most commonly used three methods of join.

Additionally, also in the case of soft soldering, known machines are limited to use exclusively electric welders, or exclusively gas welders, and in any case do not provide, for example, the possibility of simplification in welding by causing the tin to travel or move along with the opening device or being just incorporated therein.

Again, known machines are by no way capable of operating on caps and opening devices having highly variable shapes and size, being bonded to few basic types of caps and opening devices without any possibility of accomodating other different types.

A still further disadvantage in such known machines resides in the "stepping" operation thereof along a production chain or line and, therefore, even a slightest failure would suffice to shut down the entire production cycle without any possibility of shutting out the portion concerned with the failure (such as, for example, only one of the cap supports).

These and further disadvantages are avoided by a machine according to the present invention, a machine which would offer the possibility of using any of said joining methods, using gas or electric welding, effecting a prefectly centered join between caps and opening devices of the most different types, associating other auxiliary machines with the production and shutting out of damaged elements without any prejudice to the operating cycle besides the proportionate reduction in production due to such a shut out.

The invention is also concerned with novel opening devices, which are of utility from rconomical, productive or functional standpoint, all of which applicable to the caps by said machine.

By way of unrestrictive example, some embodiments of the machine and opening devices will now be shown with reference to the accompanying drawings, in which.

Figure 1:
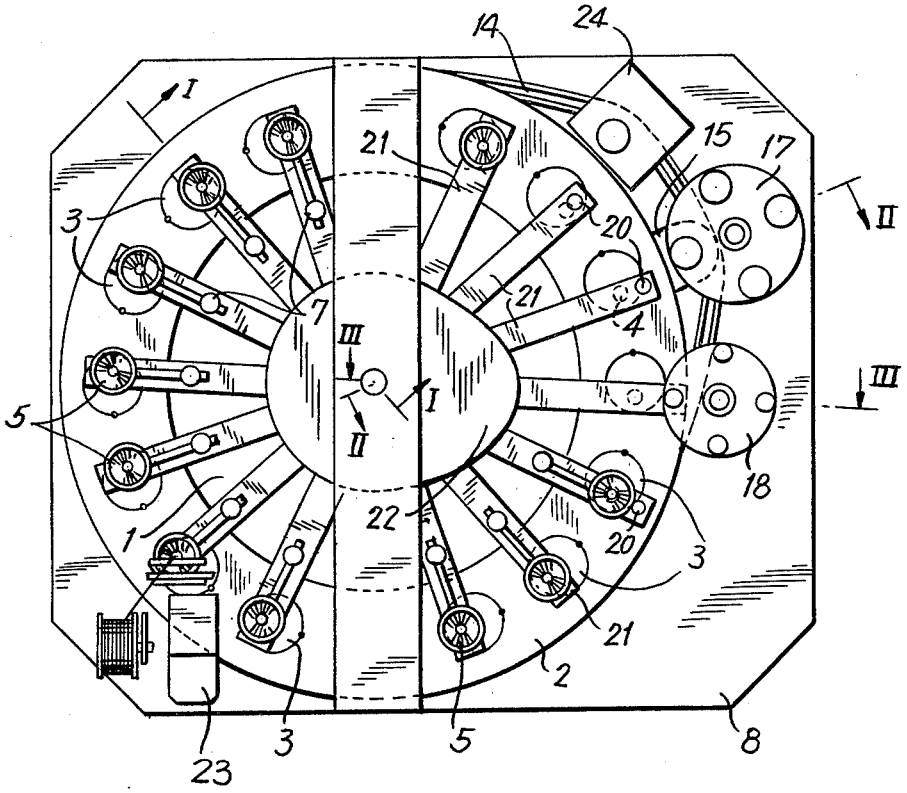
FIG. 1 is a schematic top view showing an embodiment of the machine according to the invention.
Figure 2:
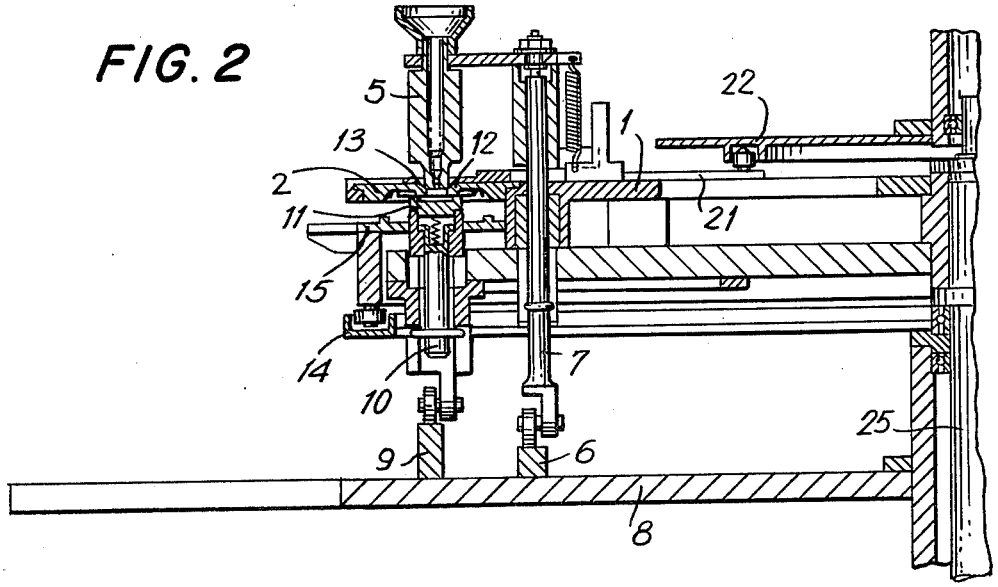
FIG. 2 is a fragmentary side sectional view taken along line I—I of the machine shown in FIG. 1.
Figure 3:
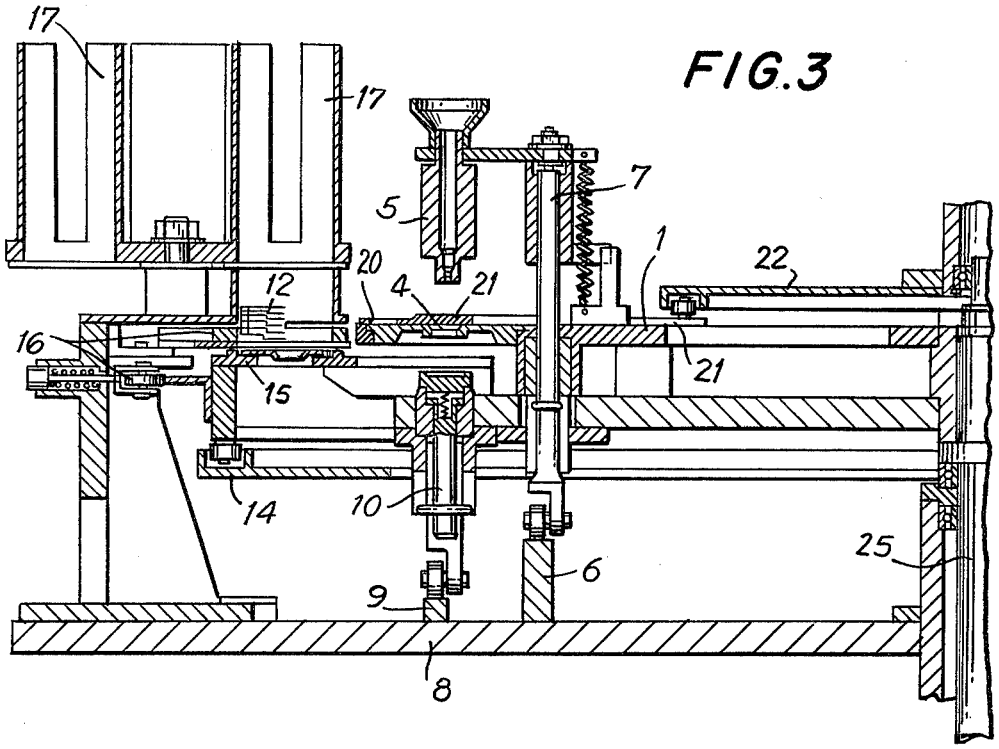
FIGS. 3 and 4 are two fragmentary side sectional views taken along lines II—II and III—III, respectively, of the machine shown in FIG. 1.
Figure 4:
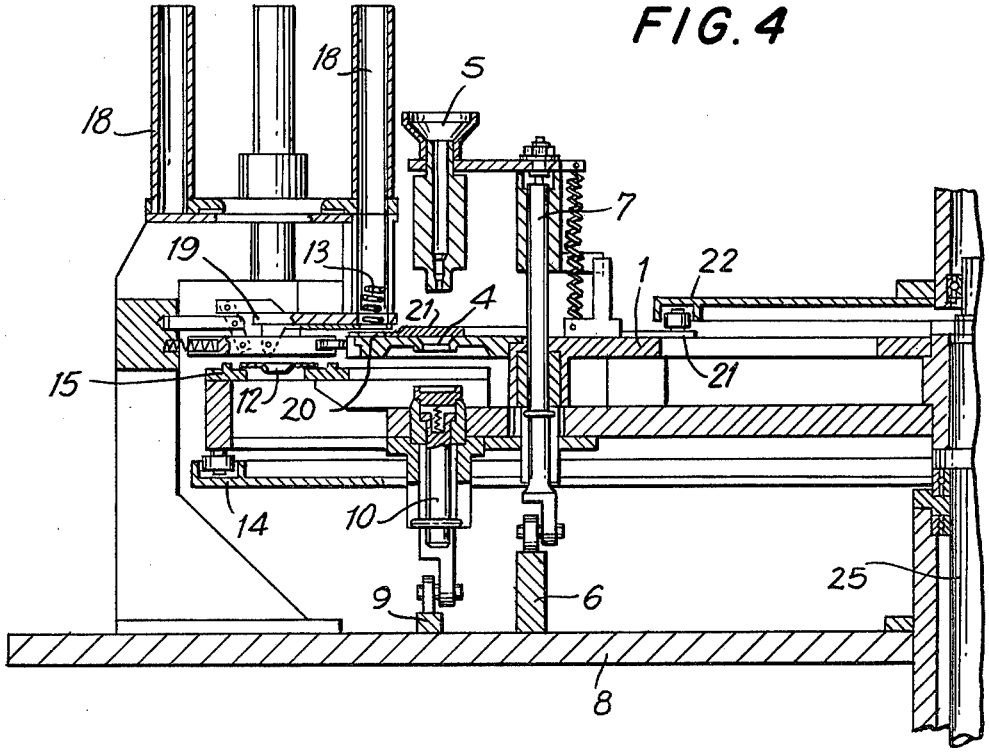

As it will be seen from FIGS. 1 through 4, a machine which as shown is designed for use of electric welders, substantially comprises a rotatable disc formed of a central portion 1 and a circular crown 2 rigidly interconnected in operation, but free for axially sliding during the initial stage of general setting up of the machine.

Plates 3 are applied along the entire circumferential development of crown and together with the latter allow to adjust the machine, so that the passage holes 4 for the tips of welders 5 can be always aligned thereto, whichever is the position or the type of caps to which the opening devices, such as tear rings, are welded. Thus, welders 5 are applied and adjusted in position at the start of each processing to the central portion 1 of the rotable disc, and during the processing are only vertically moved under the control of guide 6 extending as a varying profile circumference through rods 7 provided with feeler rollers. A second guide 9, parallel to guide 6 and also developing according to a circular path, is applied to the lower supporting plane 8 and through rods 10 provided with feeler rollers urges the upper pistons 11 to contact with caps 12, having rings 13 bearing thereon, so as to form a rigid bearing plane therefor as said welders 5 are lowered and the relative welding operation is effected.

Still at the bottom of the rotable disc, a flat guide 14 is applied with a cam-like profile and has sliding thereon the drive rollers connected to the lower slides 15 on which caps 12 are laid down during loading step by means of an automatic known type of shaped double blade device 16 enabling one cap at a time to fall down from the overlying magazine 17. On continued rotation of the rotatable disc, each of the stations having the lower slide 15 loaded with a cap are adjacent a second magazine 18, in which said rings 13 are stacked.

By a second shaped double blade device 19 one of such rings 13 is caused to fall down at a time into a suitable seat 20 of each upper slide 21, each of which receiving the radial feed drive and subsequent back-to-position drive by an upper central cam 22.

Through this movement, said upper slide 21 picks up a ring 13 from magazine 18 and, as inserted in seat 20, carries it to fall down through a passage hole 4 on an underlying cap 12, the latter being moved to position by one of said slides 15.

Then, a piston 11, relevant to the station already loaded with a cap and ring, is upward move as the respective welder 5 is lowered to reach the above described position.

Thus, the preheating step for the pieces is commenced prior to effecting the welding operation thereof, this step terminating at an also known type of tin wire dispenser 23, from which the required amount of tin is supplied for welding, the latter being carried out at a temperature not less than 600° C.

Following the operation, said welders 5 are held for some time in contact with the pieces to be tinned; finally, under control from guides 8 and 9, welders 5 are raised, pistons 11 lowered and lower slides 15, having the caps completed with ring lying thereon, will start the outgoing stroke under the control of cam 14, causing them to pass below a finished-piece extractor or puller 24, and then presenting the same again under said first magazine 17 for the start of another step.

From the foregoing, it would be apparent that such a machine is compact and of quite reduced size; moreover, the machine is made so that each of slides 15 can be readily removed from its associated seat in case of failure or the like, without having for this to stop down the processing cycle; in this case the station or stations are simply jumped over and shut off from any processing.

Finally, the rotary drive for the rotable disc is provided through a vertical shaft 25 connected to conventional geared motor and motor (not shown).

Finally, said magazines 15 and 17 can be substituted for by any other supplying devices such as, for example, series connected pressing machines fitted with an engraving unit or assembly.

Figure 5:
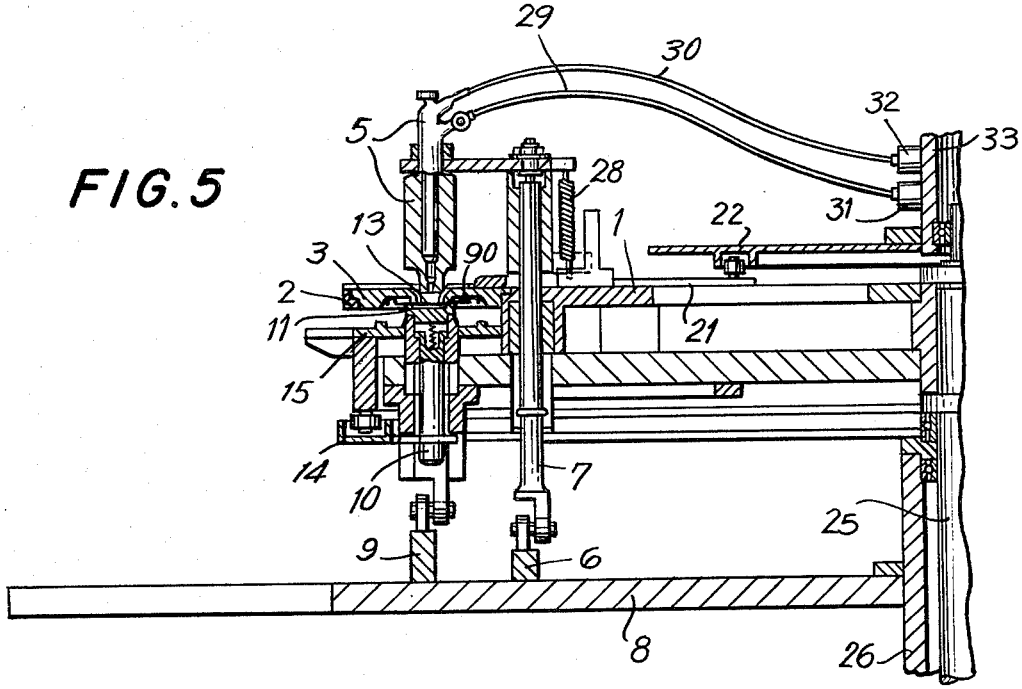
FIG. 5 is a view showing a second embodiment of the machine according to the invention in a sectional view taken along lines corresponding to I—I of FIG. 1.
Figure 6:
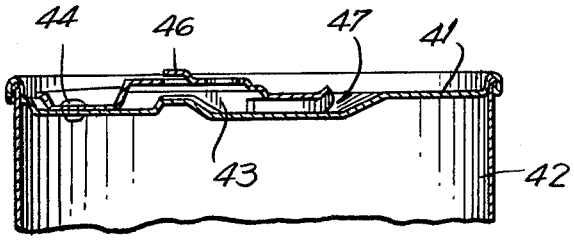
FIGS. 6 through 10 show an embodiment of a cap provided with opening device and spilling means according to the invention.
Figure 7:
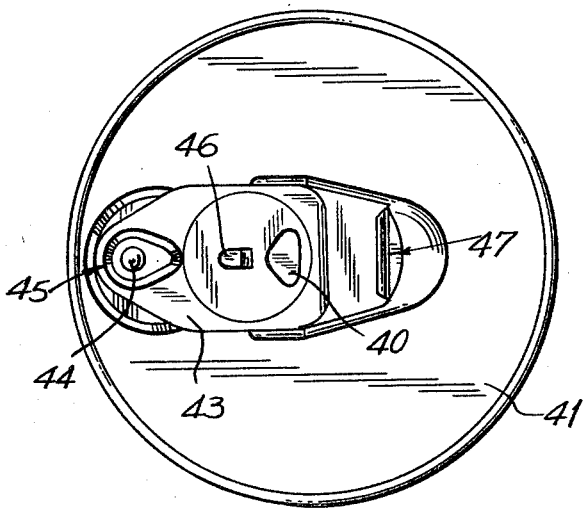
Figure 8:
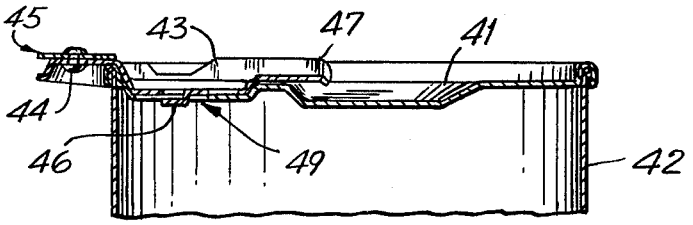
Figure 9:
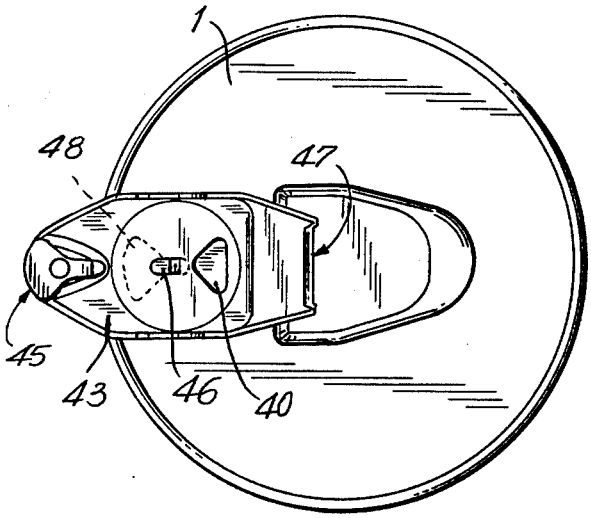

A second embodiment of the machine is shown in FIG. 5, in which welding is carried out by gas-supplied flame welders. Reference numerals have been maintained unchanged for the common parts described in the preceding figures.

The flame may be obtained by propane, methane, acetylene gas with air or oxygen. By such torches, the advantage is gained of increasing the welding rate over the other known systems, for example with respect to electric welders, and cost reduction.

At the bottom of the machine, piston 11 relative to the station loaded with a cap will move upwards, while the respective welder 5 is lowered until reaching the flame contact position with the beginning of cap preheating.

Now slide 21, having withdrawn a ring in hole 20, approaches and superimposes hole 20 to hole 4 so that the tear ring or opening device, preferably provided with tin pad, falls down in the correct location of the cap.

Welder 5 continues its preheating step, causing tin fusion with accompanying welding of said ring to the cap.

Then, by means of cam 6 said welder 5 is raised moving the flame away from the cap and cooling is anticipated by an air blow.

Air and gas, or oxygen and gas supply for torches 5 occurs through pipelines 29 and 30 connecting to annular chambers 31 and 32 located about the central axis 33. Such an axis or shaft is centrally bored for the passage of gas and air feeding tubes.

The machine is provided with magazines for caps and rings, or may be series connected with other machines such as, for example, pressing machines provided with an engraving unit or assembly and ring making machines having a tin pad directly inserted therein.

The unloading station is made with blade type of extractors or pullers, or by magnetic disc of known type and not shown.

When using the method of joining by adhesives, the above mentioned welders would be replaced by suitable adhesive dispensers fitted with set aiding pressers.

Referring to FIGS. 6 through 18, various opening devices will now be described, all of which devices are applicable to the caps by the above described machine.

Referring now to the above mentioned figures, there will be seen a cap 41 applied to a container 42 and provided with a tear opening ring in the form of a plug 43.

This plug 43 is applied to cap 41 by welding, drawing or riveting 44 placed on end 45. It is applied to the cap at upset position, so that tooth 46 is upward facing.

On outwardly pulling said plug and gripping on dispensing trough end 47, end 45 will exert a pressure on a cap portion defined by a predetermined breaking notch, thereby providing an aperture 48.

By upsetting said plug 43, tooth 46 is introduced into the rear zone 49 of aperture 48, holding said plug at radial position relative to cap 41, with said dispensing trough 47 center facing.

Thus, the cap aperture 48 is covered by the bottom plane of plug 43, whereas its pouring or dispensing aperture 40 is on a zone closed of cap 41.

Figure 10:
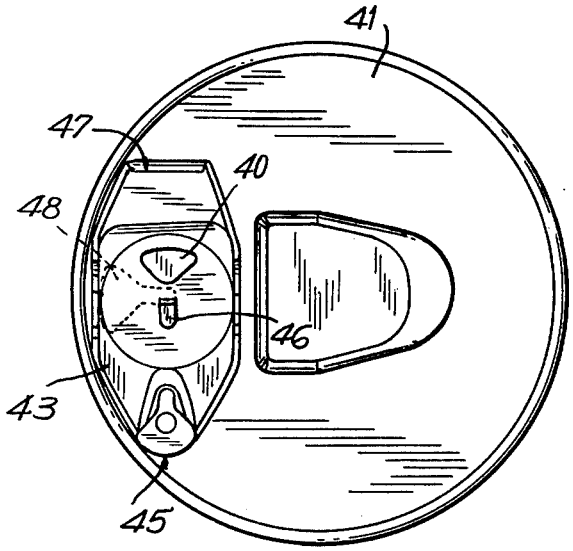

By turning said plug 43 through one quarter revolution, said tooth 46 engages on the side surface of cap 41, corresponding to zone 49 of aperture 48. Thus, plug 43 is fully engaged on cap 41 without any portion projecting therefrom, and cap aperture 48 and plug aperture 40 are not yet coincident with each other, so that when fluid is being transferred from inside of container 42 to the outside, said container is plugged and the product is protected against dust, air or any other foreign material (FIG. 10).

On continued rotation through a further quarter revolution in the same direction as the former, plug 43 is still connected to cap 41 by tooth 46, while apertures 48 and 40 are overlying and dispensing trough 47 is located outwardly of the cap.

At this time, the dispensing operation can be carried out, as the fluid is freely fed through said coincident apertures 48 and 40, and is carried through trough 47. If an increased flow is desired, a hole may be provided at the opposite side to the plug dispensing aperture, while aperture 48 of the cap may be provided at the extended narrow part, so as to coincide with the air feed hole. Said vent slit could be provided by a weakening line under the end of trough 47, which is broken by exerting a downward pressure prior to tearing. At the end of this operation, a further rotation through a quarter revolution brings said plug 43 back to not hindering transverse position, and cap aperture 48 is closed again by the bottom plane of said plug.

The device shown is particularly suitable for application to containers of fluid products, such as alimentary oils, drinks or in any case products to be preserved against dust, air and the like. It is substantially made of metal material and can be indifferently applied to caps made of tinned strap, aluminum or any other suitable material.

Figure 11:
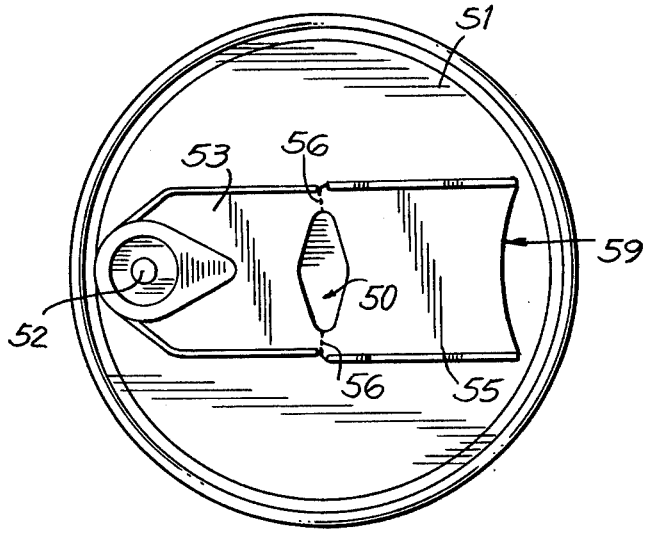
FIGS. 11, 12 and 13 show another embodiment of a cap provided with opening device according to the invention.
Figure 12:
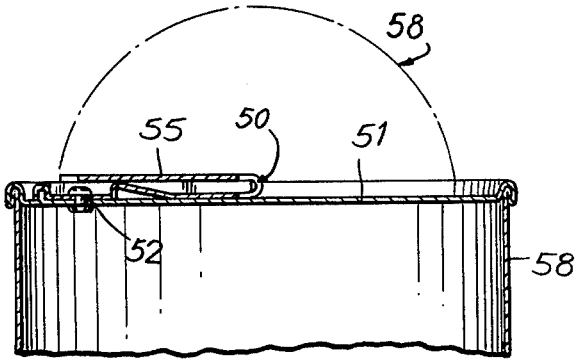
Figure 13:
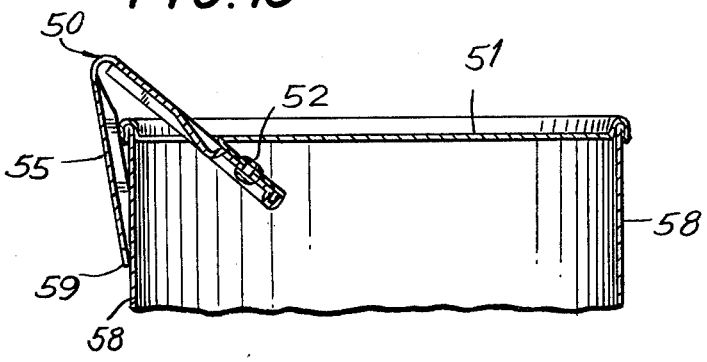

FIGS. 11, 12 and 13 depict another type of tear device 53. Unlike the former devices, this device remains attached to the cap 1 of the container 58.

For opening, it should first be acted on the end portion 55 of the extension projecting from ring 53, by folding it up on itself at the level of minor resistance sections 56, so as to form a boxed element with the ring extension.

The folding up movement is accomplished by following the pattern or course of dashed arc 58. The subsequent tearing action exerted on ring 53 causes the rotation of the boxed element until the end 59 of end portion 55 bears against the end wall of container 58. Thus, slit 50 is on the outer end of the boxed element, thereby forming the outlet mouth for the fluid outflowing from the container 58 through the aperture provided by ring 53 on the preferential break section wall of cap 51.

In this case, the dispenser is integral with opening device 53 and remains connected to cap 51 by the drawing or tin welding 52.

This embodiment is particularly suitable for pouring of lubricating oils and the like.

Figure 14:
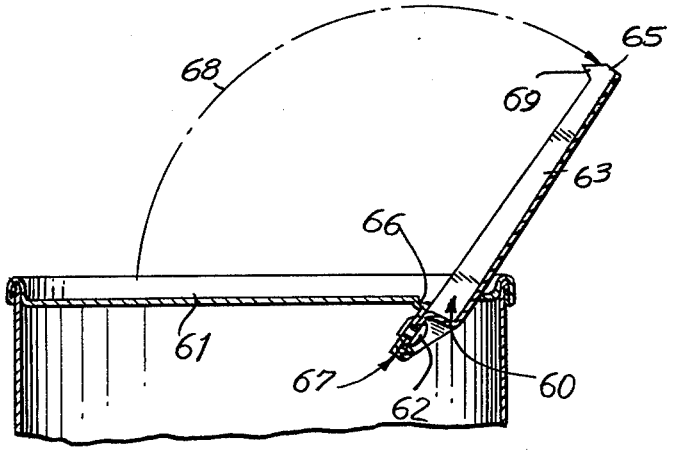
FIGS. 14 through 18 show further embodiments of caps provided with opening devices according to the invention.
Figure 15:
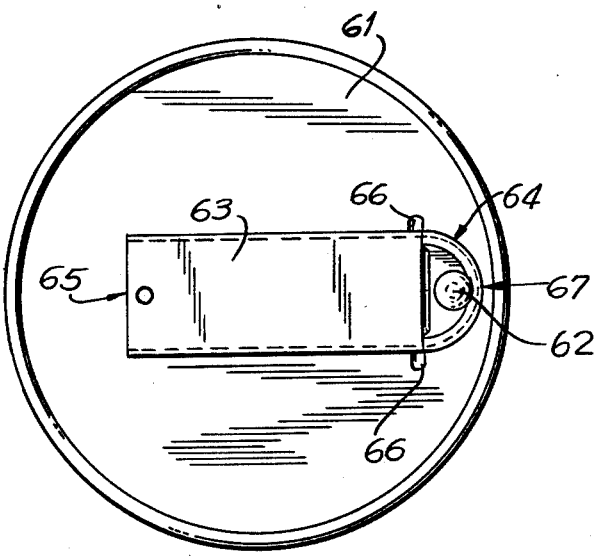
Figure 16:
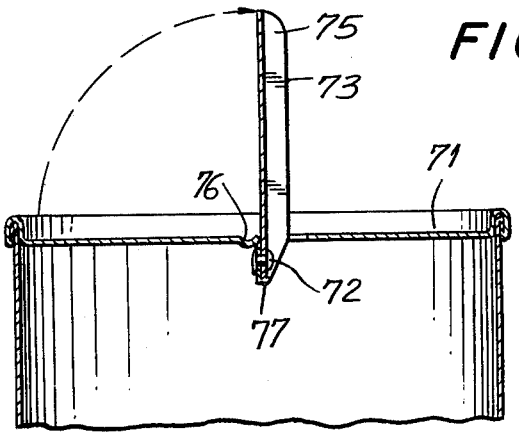

In FIGS. 14 through 16 two tearing devices are shown as fitted with a simplified type of dispensing trough.

By drawing, riveting or welding 62, an opening device 63 is applied to cap 61, this opening device having a profile substantially in the form of an elongated trough.

Said ring or trough 63 is applied to the cap at upset position and the cap zone, wherein the connection 62 is provided, is located at the cap periphery and provided with a predetermined breakage notch or engraving 64. The front portion 62 of trough 63 is centrally cut and cantilevered to adhere on the cap plane.

By outwardly pulling the end 65 of trough 63, the latter is caused to rotate about the shaped transverse section 66 so that, by exerting a pressure on said notch or engraving 64, end 67 will cause the breakage of cap 61. Preferably, on end 65 said trough 63 is provided with two or more tips 69 engraving by pressure said cap 61 before the latter is raised: thus, one or more vent holes are provided and aid in contents flow. Alternatively, tips or teeth 69 can be replaced by a predetermined engraving tear plate, which is connected to cap 61 by riveting, drawing or welding at the opposite side to dispensing location.

Trough 63 is rotated in the direction of arrow 68 until taking the position shown in FIG. 12. Now, the fluid in the container can be readily poured or dispensed since, by passing through aperture 60 on cap 61 and through the cantilever aperture of trough 63, it flows on the latter, which can be readily directed in the desired direction.

FIG. 16 shows a further modification.

In this case, trough 73 is applied to cap 71 at upright position by a drawing, riveting or welding 72 located at about centrally of cap 71, and the cap portion on which connection 72 is made is provided a predetermined breakage notch or engraving and a shaped transverse bending profile 76.

By outwardly pulling the end 75 of trough 73, the latter is caused to rotate about shaped profile 76, so as to exert a pressure on end 75, which causes the breakage of cap 71 along said notch or engraving.

As rotated to take a vertical position relative to the cap, said trough is ready for use as flow guide during the pouring of the fluid in the container.

Figure 17:
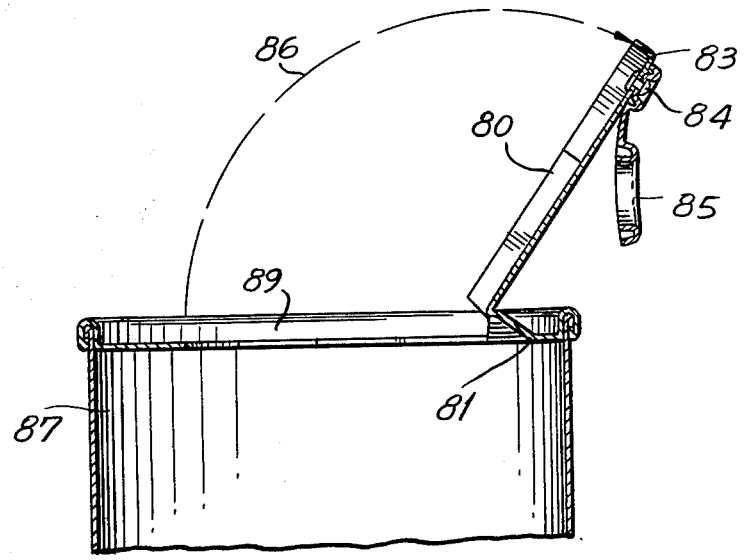
Figure 18:
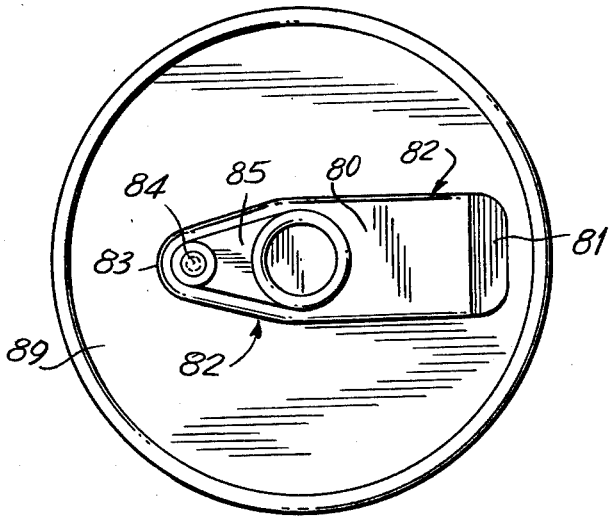

FIGS. 17 and 18 show a further embodiment of the opening device.

Cap 89 is made with a longitudinal central shaping 80, provided along its profile except for the end zone 81 with a predetermined breakage notch or engraving 82.

A conventional type of tear ring 85 is applied to the opposite end 83 of shaping 80 by drawing, riveting or welding 84.

By outwardly pulling said ring 85, a pressure is exerted which causes the separation of shaping 80 from cap 89 along the breakage notch 82.

By rotating shaping 80 according to arrow 86 to move said shaping to the position of FIG. 18, a dispensing trough is provided for carrying the fluid outflowing from container 87 during pouring operation.

The tear opening devices provided with a dispenser, as above described, are particularly suitable for application to containers for lubricating oils and the like.

Such devices are made of metal material or other suitable materials and can be indifferently applied to caps of tinned strap, aluminum or other suitable material.

I claim

1. An automatic machine for continuously producing tinned strap caps fitted with a tear opening device, characterized by comprising a disc rotating about its axis at a constant speed, including a central portion and an outer circular crown, the latter being provided with a first plurality of supporting elements or lower slides, only radially movable to receive the caps supplied by a shaped double blade magazine, and a second plurality of supporting elements or upper slides, also only radially movable, to receive the tear opening devices supplied by a second double blade magazine, said crown being also provided with a plurality of passage holes, through which each of the tear elements are positioned on the corresponding cap, the central portion carrying a plurality of joining members only vertically movable, further characterized in that the radial movement for the lower slides adjacent the cap dispenser or magazine is controlled by a flat metal cam-shaped guide, during the movement of the rotable disc, drive rollers connected to said lower slides sliding therein, that the radial movement for the upper slides adjacent the tear element dispenser is controlled by a central cam integral with the axis of rotation for the ritable disc, that the vertical movement for the joining members is controlled by a circular metal guide of varying height, in which feeler rollers slide following the profile thereof and transferring such a movement to the joining members by connection stems, further characterized in that a further circular metal guide of varying height controls the lifting and lowering of a plurality of abutting pistons raising with the underside of the caps and by providing an extractor or puller for the finished pieces located adjacent the dispensers or magazines, but upstream thereof.

2. A machine according to claim 1, characterized in that said joining members comprise electric or gas welders.

3. A machine according to claim 2, characterized by providing a tin dispenser dispensing a predetermined amount of tin at the welder tip.

4. A machine according to claim 1, characterized in that the cap has a projection inserting during forward movement in a suitable hole of the tear element and is riveted by the combined action of the pistons and joining members comprising shaped pressers.

5. A machine according to claim 1, characterized in that said joining members comprise adhesive dispensers associated with pressure members acting in combination with said pistons.

6. A machine according to claim 1, characterized in that said passage holes are provided on replaceable metal blocks or pans and are of a shape depending on that of the tear element.

* * * * *